United States Patent [19]

Weihrauch

[11] Patent Number: 4,749,233

[45] Date of Patent: Jun. 7, 1988

[54] METHOD FOR THE MANUFACTURE OF BRISTLE PRODUCTS

[75] Inventor: Georg Weihrauch, Waldmichelbach, Fed. Rep. of Germany

[73] Assignee: Coronet-Werke Heinrich Schlerf GmbH, Waldmichelbach, Fed. Rep. of Germany

[21] Appl. No.: 831,575

[22] Filed: Feb. 21, 1986

[30] Foreign Application Priority Data

Feb. 21, 1985 [DE] Fed. Rep. of Germany ..... 3505972

[51] Int. Cl.[4] ..... A46D 1/08

[52] U.S. Cl. ..... 300/21; 300/6

[58] Field of Search ..... 300/4, 6, 21

[56] References Cited

U.S. PATENT DOCUMENTS 2,035,709 3/1936 Laub et al. ..... 300/4

3,311,416 3/1967 Zahoransky ..... 300/4

4,132,449 1/1979 Bergman ..... 300/4

*Primary Examiner*—Timothy V. Eley

*Attorney, Agent, or Firm*—Antonelli, Terry & Wands

[57] ABSTRACT

A method and apparatus for the manufacture of bristle products, such as paintbrushes, brushes, brooms and the like, which comprise a bristle carrier and bristle bundles fixed thereto. The bristles are drawn from a continuous strand on a storage reel and pass through a mould, so that the strand is given a random cross-sectional shape. Downstream of the mould, the reshaped continuous strands are fixed to a bristle carrier and then bristles are cut to the desired length, so that the bristle bundles can be given different shapes and the bristle material can be continuously processed from the reel. The cross-sectional shape of the individual bristle bundles can be adapted to the particular intended use.

7 Claims, 4 Drawing Sheets

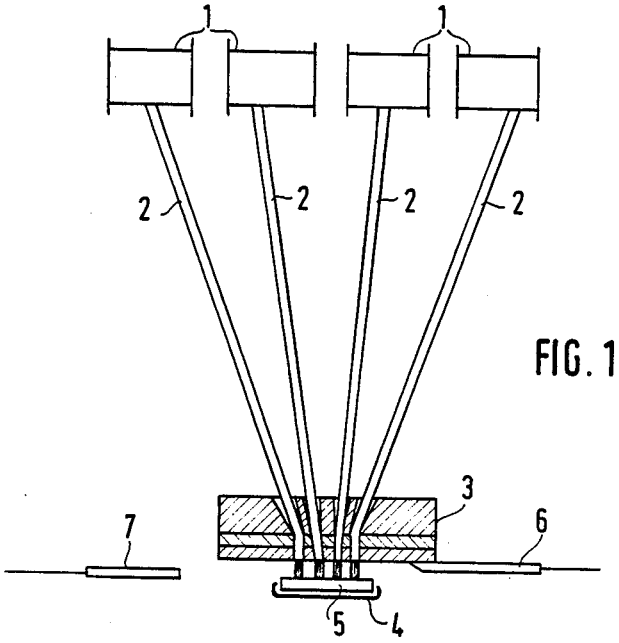
FIG. 1
FIG. 2
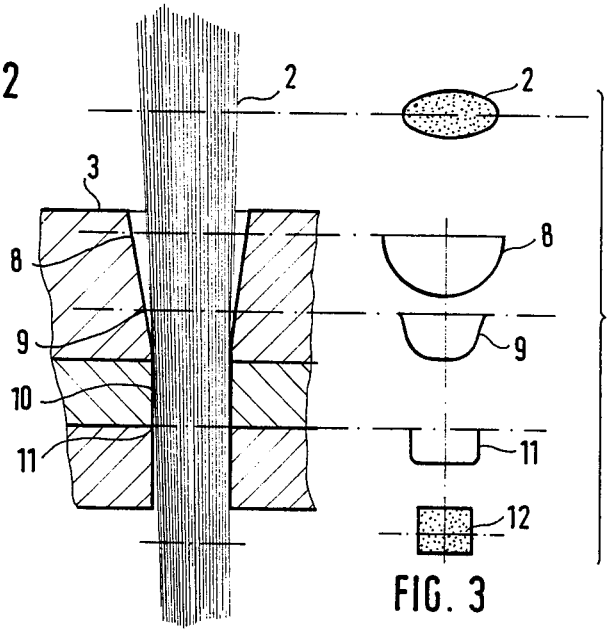
FIG. 3

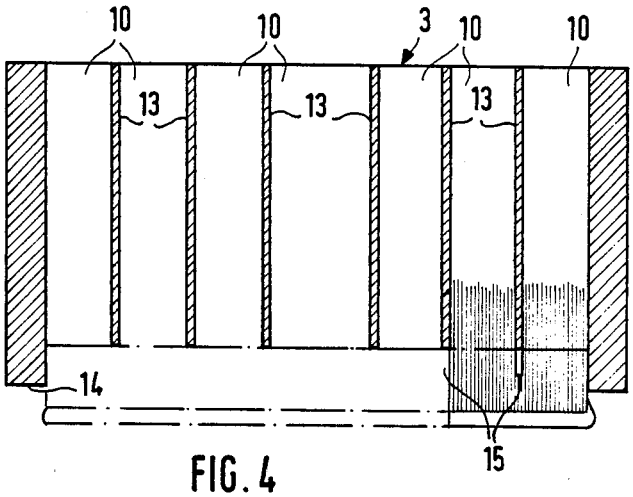
FIG. 4
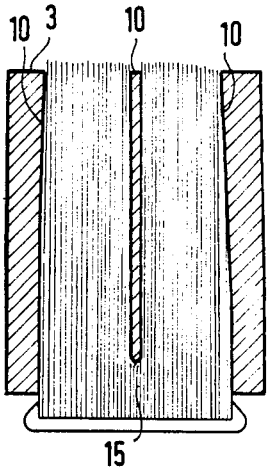
FIG. 5
FIG. 6
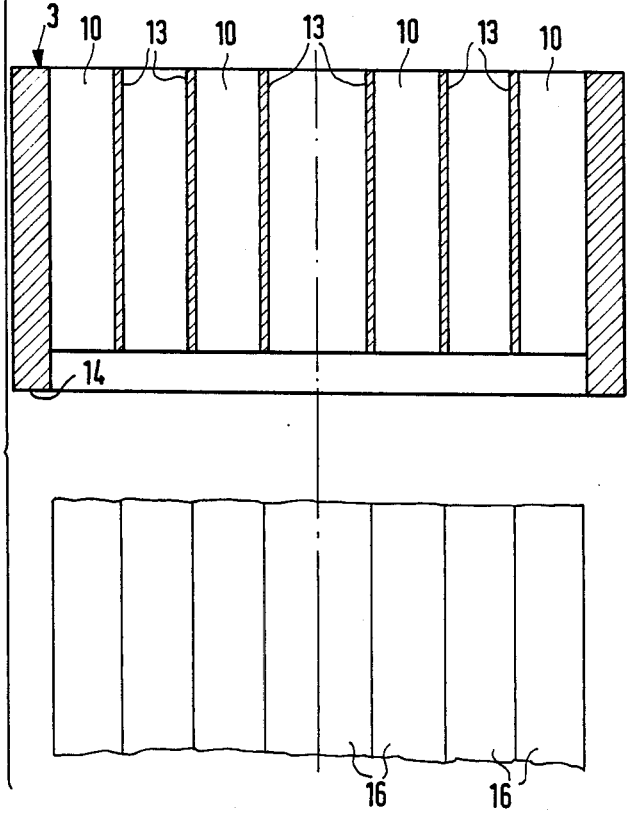
FIG. 7
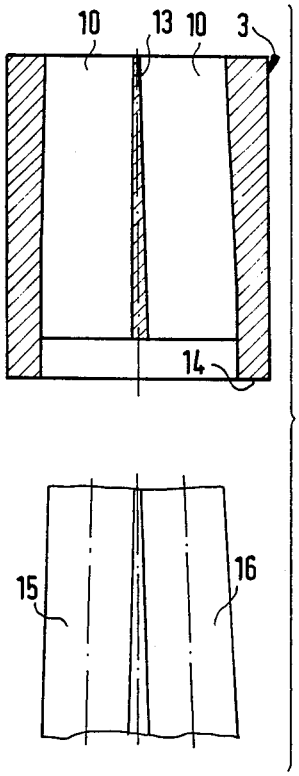

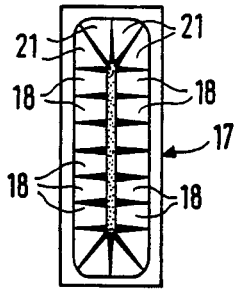
FIG. 8
FIG. 9
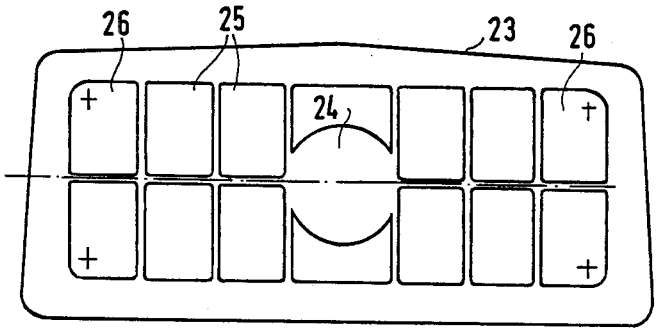
FIG. 10
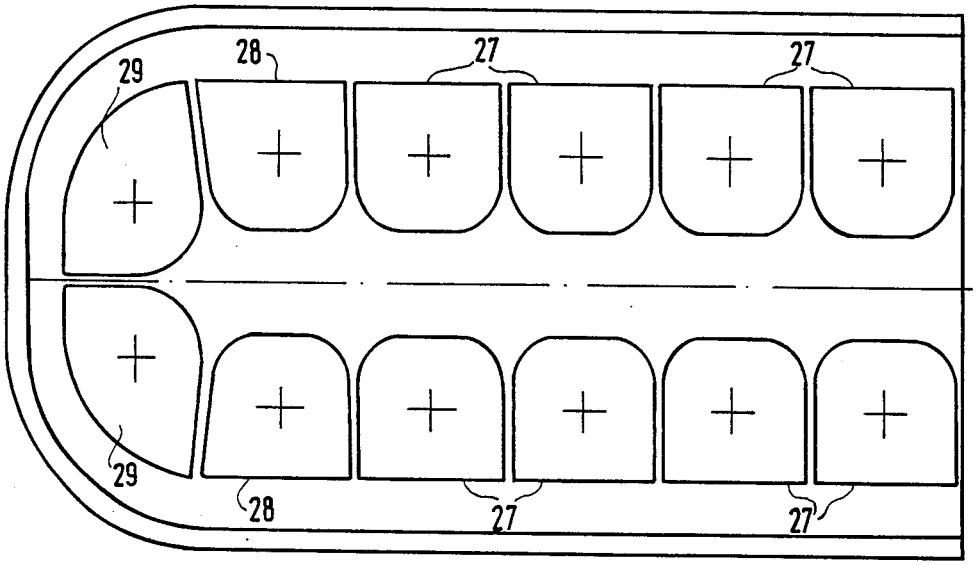

METHOD FOR THE MANUFACTURE OF BRISTLE PRODUCTS

BACKGROUND OF THE INVENTION

The present invention relates to a method and apparatus for the manufacture of bristle products, such as paintbrushes, brushes, brooms and the like comprising a bristle carrier and bristle bundles fixed thereto, with the plastic bristles, combined into a continuous strand, being drawn from a storage reel, delivered to the bristle carrier, fixed thereto and cut to length.

With the present extensive use of plastic bristles, increasing significance is attached to a continuous strand processing, because the starting material is extruded and consequently obtained in a continuous form. Following stretching it is wound onto reels or flat rolls. In conventional processing, the continuous material is combined from a large number of monofilaments and packed in the form of large bundles or bristle groups. In this form, the bristle groups are supplied to bristle product manufacturers. For processing purposes, the packing must be removed, the bristle group placed in the machine magazine and then broken down to smaller bundles corresponding to the desired bundle thickness. As these operations are cost intensive both for the bristle manufacturer and for the processor, it was obvious to carry out processing from the endless strand, in that the bristle manufacturer forms the material into reels, which are then supplied to the processor. With the knowledge of the advantages of this operation, numerous proposals have been made in, for example, DE-OS No. 28 47 781 and DE-OS No. 28 49 510, for setting up the bristle product manufacturing machines in such a way that the bristles can be processed as continuous material from the reel, wherein the continuous strand is drawn from the storage reel, delivered to the bristle carrier, with the free end of the continuous strand being fixed to the bristle carrier. Since, as a result of its manufacture, the continuous strand has a roughly round to flat-oval cross-section, it is only possible to produce those bristle products in which the bristle bundles are desired or can be accepted with a corresponding cross-section, which is the case with most bristle products. However, in certain cases bristle bundles with other cross-sections, e.g. a prismatic cross-section are necessary or at least desired, such as is e.g. the case with paintbrushes. There are also bristle products in which bristle bundles with a different cross-sectional shape and different cross-sectional surface would be advantageous, but such a bristle bundle use has not taken place due to the lack of rational manufacturing methods. It has already been proposed in German Utility Model Nos. 80 04 640 and 84 03 491 to provide bristle holes with a polygonal cross-section in bristle carriers and then to fix the bundles mechanically therein, but the holes have only been inadequately filled, so that dirt collects therein.

SUMMARY OF THE INVENTION

The aim underlying the present invention essentially resides in providing a method and an apparatus for the manufacture of bristle products, with the aid of which bristle bundles with a random cross-section can be produced and the same can be processed to bristle products with random bristle areas.

On the basis of the aforementioned method with processing from the continuous strand, this problem is solved in that, on delivering the continuous strand to the bristle carrier, it is reshaped by a pressure acting laterally on its entire circumference to a cross-section differing from the original shape and, upon reaching the desired cross-sectional shape, it is fixed to the bristle carrier.

The invention firstly takes advantage of the already recognized, but not practically realized advantages of processing from the continuous strand and offers the possibility, through strand reshaping by exerting a lateral pressure, to bring the strand into any random cross-sectional shape and from the strand and, while maintaining the cross-sectional shape imparted thereto, fixing the bristles to the bristle carrier. Thus, it is no longer necessary, when processing bristle material, to first manufacture the cut material and use suitable reception means such as proposed in, for example, German Pat. No. 23 35 468 and DE-AS No. 26 46 048 to pick the cut bristles from a larger magazine and deliver the same up to the bristle carrier. Instead of this, the invention works from a continuous strand via a reshaping process, much as is used during profiling from other continuous material. The pressure acting laterally on the complete circumference of the continuous strand must be such that the individual monofilaments within the strand are displaced and rearranged so that finally the desired cross-section is obtained and this is retained up to the fixing point.

According to an advantageous embodiment of the inventive method, the pressure acting laterally on the continuous strand is lower in the region before the fixing point than in the previous region. Thus, the strand is initially exposed to the pressure necessary for its reshaping and then said pressure is reduced after reaching the desired cross-section, so that the individual bristles acquire a certain freedom of movement within the strand again. Thus, the bristles spread apart somewhat at the leading end of the strand, so that after fixing the bristles to the bristle carrier there are small gaps between the individual bristles in the vicinity of the bristle carrier. This is desirable in certain cases, e.g. in application or coating means, such as paintbrushes, artists' brushes, in order to store the application or coating medium within the means between the bristles and the medium can then be successively supplied.

In the case of the aforementioned prior art, it is known to bring up to the bristle carrier several continuous strands on reels in accordance with the number of bristle bundles to be fixed to the bristle carrier, so that e.g. a bristle carrier can be completely equipped with bristles in one operation. Even in the case of such a miltiple supply of continuous strands, they can still be brought to the desired cross-sectional shape. It is in particular possible to reshape the continuous strands to varying cross-sections, so that e.g. a bristle carrier of given contour can be completely occupied by bristles. It is also possible to simultaneously process continuous strands of different cross-sections.

In order to be able to manufacture bristle bundles with a larger number of bristles from individual continuous strands with, in each case a given number of monofilaments, according to a further embodiment of the invention several continuous strands are brought together and jointly reshaped to a random cross-section by exerting a lateral pressure.

The invention in particular provides the possibility of reshaping the continuous strands to prismatic cross-sections, which are favorable and even a prerequisite when the bristles are to occupy the complete bristle carrier surface.

In accordance with another embodiment of the present invention, the number of continuous strands and their cross-sectional shape can be selected in such a way that the bristle carrier surface is fully occupied, while there is a substantially constant spacing between the facing sides of the bristle bundles at the fixing surface. In other words in the case of reshaping to a prismatic, e.g. rectangular and optionally triangular cross-section, randomly large surfaces can be completely occupied with bristles and between the individual bristle bundles only narrow channels are left. These can once again be used in applicators for maintaining the application medium in the applicator.

The method according to the invention with the above described features has the advantage that the packing density of the bristles can be varied as a result of the lateral pressure during reshaping or following the same, which is not possible in the case of the known picking out of bristle bundles or groups of random cross-section from magazines with cut material such as proposed in, for example, German Pat. No. 23 35 468 and DE-AS No. 26 46 048. In such cases, in order to be able to perform the picking out process, the picking out form must exert a lateral pressure on the bristles and which is mainly caused by wedging and this is maintained in said form until the bristles are fixed to the bristle carrier. The inventive method also leads to the major advantage that it is possible to satisfactorily process very thin bristles, which is not possible when picking out from magazines with cut material, because such bristles easily give way, bend and are finally permanently deformed. This more particularly applies in connection with the production of paintbrushes, toothbrushes, etc.

For performing the above method, the invention is based on a known apparatus such as proposed in, for example, DE-OS No. 28 47 781 and DE-OS No. 28 49 510, with at least one storage reel, which receives at least one bristle continuous strand, a removal means for the continuous strand, a cutter, a retaining device for the bristle carrier, a device for fixing the bristles to the bristle carrier and a cutter. Such an apparatus is characterized in that upstream of the device for fixing the bristles is provided a mould with at least one channel carrying the continuous strand and whose cross-section corresponds to the desired cross-section of the bristle bundle and whose cross-sectional surface approximately corresponds to that of the continuous strand.

In the case of the apparatus according to the invention, the continuous strand is drawn from the reel and passed through the mould, where its originally circular cross-section is changed into the desired cross-sectional shape. The cross-sectional surface remains roughly the same, so that the bristles in the mould are merely displaced and moved against one another, but an excessively strong lateral pressure does not build up a high tensile stress. Following the mould, the continuous strand is brought up to the device for fixing the bristles to the bristle carrier and, following fixing by welding, bonding and moulding in, cutting to length takes place by the cutter.

According to a preferred construction, the mould has a plurality of closely spaced, juxtaposed guide channels for in each case one of several continuous strands. Thus, the complete or large parts of a bristle carrier surface can be simultaneously occupied with bristle bundles of a random cross-section. The spacing between the individual guide channels is selected in accordance with the requirements concerning the characteristics of the bristle product to be manufactured. If all the bristles are to be as close as possible, then the spacing is correspondingly minimized. However, if gaps are desired between the individual bristle bundles, then the spacing will be increased. Random bundle configurations and bristle surfaces of random geometry can be produced.

Appropriately each guide channel has, at the inlet side of the strand, a circular cross-section, whose cross-sectional surface is at least as large as that of the unshaped strand and if the circular cross-section gradually passes into the final cross-section. Thus, on putting into operation, the insertion of the leading end of the continuous strand is facilitated and there is also an optimum force-free reshaping from the original to the desired cross-section.

According to another advantageous embodiment, the cross-section of the guide channels is increased somewhat at the outlet side of the endless strands. As described hereinbefore relative to the method, this construction provides the possibility of the bundles expanding and the bristles spreading out, practical tests having shown that on maintaining the shaped cross-section, the spacing between the individual bristles is approximately the same. This is particularly desired in the case of paintbrushes and brushes used for the application of liquid or pasty media and which are intended to store the medium.

If the mould has several guide channels, then according to a preferred embodiment, the partitions arranged between the guide channels taper to pointed edges at the outlet side of the continuous strands. This ensures that also when several strands are supplied, the bristles spread out at the leading end of the strands and the bristles of adjacent strands are brought together. This effect can be further favorably influenced in that the partitions arranged between the guide channels end at a distance from the outlet-side face of the mould.

Finally, according to another embodiment, adjacent guide channels or adjacent rows of guide channels diverge under a small angle toward the outlet side. As a result, the continuous strands are moved apart somewhat in the direction of the bristle carrier arranged behind the mould and for each individual bristle bundle or complete rows of bristle bundles or areas, this can take place under the same or different angles. After fixing the bristles to the bristle carrier, the bristles move towards one another in sloping manner towards the free end, which is also particularly desired in the case of applicators. Thus, at the free ends, a bristle termination is obtained which prevents the free escape of the application medium, so that the latter only escapes under the application pressure and movement.

BRIEF DESCRIPTION OF THE DRAWINGS

The invention is described in greater detail hereinafter relative to non-limitative embodiments and the attached drawings, wherein show:

FIG. 1 A diagrammatic view of an apparatus.

FIG. 2 A section through an individual mould with an endless strand of plastic bristle material;

FIG. 3 Several cross-sections (partly in halves) according to the representation of FIG. 2;

FIG. 4 A composite mould in longitudinal section;

FIG. 5 A cross-section through the representation of FIG. 4;

FIG. 6 A composite mould similar to FIG. 4 in longitudinal section;

FIG. 7 A cross-section for the representation of FIG. 6;

FIG. 8 A diagrammatic section for the bristles on a flat paintbrush;

FIG. 9 A diagram for the bristles on a brush or the like;

FIG. 10 A view similar to FIG. 9 of a modified embodiment; and

DETAILED DESCRIPTION OF THE PREFERRED EMBODIMENTS

Figure 11:
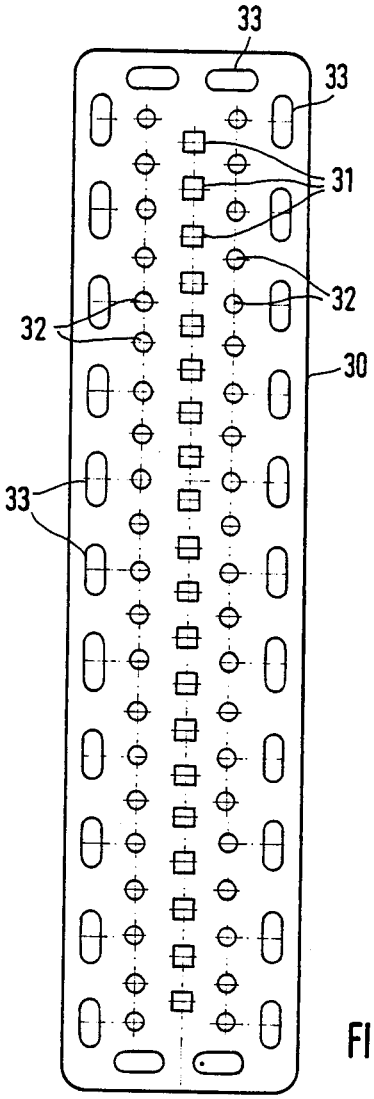
FIG. 11 A diagram for a device with bristle bundles of different cross-section and different cross-sectional surface.

The apparatus diagrammatically shown in FIG. 1 has a plurality of reels 1 installed in a frame (not shown). Each reel receives at least one continuous strand 2 of bristle material. A reeling off device (not shown) is provided, by means of which the continuous strands 2 are supplied to a mould 3. The apparatus also has a device 4 for holding a bristle carrier and a cutter 6, by means of which the strands 2 pass through mould 3 and are cut to the desired size after fixing their leading ends to bristle carrier 5. FIG. 1 also diagrammatically shows a device 7 for fixing the bristle bundles or the leading ends of the endless strands 2 to the bristle carrier 5, with the fixing device being, for example, a welding device, by means of which both the leading ends of strands 2 and the plastic bristle carrier 5 are melted and following the removal thereof the bristle carrier 5 is brought by means of the holding device 4 up to the melted bristle ends. Following adequate cooling of the melt, holder 4 with bristle carrier 5 and the welded on endless strands can be drawn on by a bristle length, after which the cutter 6 is put into operation and a further bristle carrier is delivered.

In mould 3, the originally circular or flat-oval continuous or endless strands 2 are reshaped by a pressure acting laterally over the entire circumference. As shown in FIG. 2, the mould 3 has a preferably conical, circular intake portion 8, which tapers downwards and a cross-sectional shape changes in a transition zone 9 and finally passes into a guide channel 10, whose cross-sectional plane 11 is rectangular, e.g. square. Correspondingly on passing through mould 3, continuous strand 2 is reshaped to a rectangular and, in particular, square cross-section 12, so that said mould leads to square bristle bundles. In place of the square cross-section 11, it is naturally possible to produce other prismatic cross-sectional shapes.

FIG. 4 shows a mould 3 with a plurality of guide channels 10 and, for reasons of simplicity, the conical intake zone is not shown. Between the individual guide channels there are only thin-walled partitions 13, so that the individual bristles of the endless strands pass through each guide channel 10 and pass out of the outlet-side face 14 in immediately juxtaposed form. As can also be seen at the outlet-side face 14, partitions 13 taper in region 15. As a result the leading ends of the bristles of the individual continuous strands spread out at the discharge side and pass out in a dense, regular layer. In the represented embodiment, the guide channels 10 are juxtaposed in two rows, cf. FIG. 5. The ends of the continuous strands passing out of mould 3, as has already been described with reference to FIG. 1, are joined by melting to one another and to the bristle carrier.

The embodiment of FIGS. 6 and 7 differs from that according to FIGS. 4 and 5 in that the partitions 13 terminate at a distance upstream of the outlet-side face 14 of mould 3. This further aids the fanning out of the leading ends of the bristles within the endless strands. As can also be seen from FIG. 7, partitions 13 between adjacent rows of guide channels 10 have an increasing wall thickness towards the outlet-side face 14. Thus, the guide channels 10 diverge in the direction of face 14, so that the continuous strands shaped in the two rows of guide channels 10 pass out at an angle to one another. Thus, bristle bundles 15, 16 are obtained, which slope at an angle to one another and in the vicinity of the bristle carrier are spaced, so that chambers are formed between them, which can e.g. be used for storing and holding back an application or coating medium. This embodiment is particularly advantageous in the manufacture of paintbrushes, artists' brushes, etc.

FIG. 8 diagrammatically shows the bristle occupation area of a paintbrush 17. It comprises two spaced rows of rectangular bundles 18, the bundles having a limited spacing from one another. This leads to a central chamber 19 and several narrow chambers 20, which once again retain the application medium, e.g. paint. Optionally, the bristle bundles 18 can differ slightly from the rectangular shape, so that the chambers 20 formed between them have an increasing cross-section from the outside to the inside. The bristle occupancy can also be such that the chambers are closed on the outer contour. In the vicinity of the narrow sides of brush 17, it is either possible to provide a large rectangular bundle or, as shown in the drawing, several bundles 21 with a triangular cross-section.

FIG. 9 shows the bristle occupancy area of a brush or paintbrush for applying media housed in a tank. For this purpose the bristle carrier 23 e.g. has a hole or channel 24. By means of its side remote from the bristle area, it can be mounted on the opening of a tank containing the medium to be applied, which can penetrate through the hole or channel 24 into the bristles. Once again largely rectangular bristle bundles 25 are provided, while the bristle bundles 26 in the corners have a somewhat modified cross-section, in that the corners are rounded.

FIG. 10 shows a modified bristle occupancy area for a brush, in which the round continuous strands are reshaped to bristle bundles 27, 28, 29, which form a largely closed outside of the bristle area, whose entire surface is occupied. The special feature is that despite the different cross-sectional shape of the bristle bundles 27, 28, 29, they have the same cross-sectional surface.

In the embodiment according to FIG. 11, which is e.g. used for brooms, in the central region of the bristle carrier 30 are provided a row of bristle bundles 31 with a square cross-section and alongside the same is provided a row with bristle bundles 32 with a circular cross-section, obtained from a continuous strand with a circular cross-section. Unshaped continuous strands can be used for bristle bundles 32. The three rows of bristle bundles 31 and 32 are externally surrounded by bristle bundles 33 with an elongated rounded cross-section, which are e.g. produced from three strands by bringing together and corresponding reshaping. This shows the many possible variations, which result from the reshaping of the continuous strands to other cross-sectional shapes. The different cross-sectional shapes can be chosen in the way in which they are particularly required for the use of a particular apparatus, e.g. a relatively rigid bristle bundle form in the central area and a soft form in the outer area or vice versa.

What is claimed is:

1. A method for manufacturing bristle products including a bristle carrier and bristle bundles fixed thereto, the method comprising the steps of drawing plastic bristles combined into a continuous strand from a storage reel, delivering the continuous strand to the bristle carrier, fixing an end of the continuous strand to the bristle carrier, and cutting the continuous strand to a predetermined length, wherein the step of drawing includes reshaping the continuous strand to a cross-section differing from an original cross-sectional shape during the step of delivery of the continuous strand to the bristle carrier by applying a pressure laterally acting on an entire circumference of the continuous strand and, wherein the step of fixing the continuous strand is effected after reaching the desired reshaped cross-sectional shape.

2. A method according to claim 1, wherein the pressure acting laterally on the continuous strand is smaller in a zone upstream of a fixing point of the continuous strand.

3. A method according to one of claims 1 or 2 wherein a plurality of continuous strands are provided corresponding to a number of bristle bundles to be fixed to the bristle carrier and are delivered to the bristle carrier, and wherein the continuous strands are reshaped to differing cross sections.

4. A method according to claim 3 wherein the plurality of continuous strands are reshaped to differing cross-sections with the same cross-sectional surface.

5. A method according to claim 3, wherein the plurality continuous strands and their cross-sectional shape are selected so that the bristle carriers are completely covered with bristles at the fixing point.

6. A method according to claim 1, wherein several continuous strands are combined and jointly reshaped to an individual strand of a random cross-section by the laterally acting pressure.

7. A method according to claim 5, wherein the several continuous strands are reshaped to prismatic cross-sections.

* * * * *